US008000633B2

(12) United States Patent
Kato et al.

(10) Patent No.: US 8,000,633 B2
(45) Date of Patent: Aug. 16, 2011

(54) CHARGING MEMBER, CHARGING DEVICE, IMAGE FORMING APPARATUS, AND PROCESS CARTRIDGE

(75) Inventors: Masahito Kato, Suntou-gun (JP); Norihito Naito, Numazu (JP); Takayoshi Kihara, Suntou-gun (JP); Takashi Kase, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 12/540,971

(22) Filed: Aug. 13, 2009

(65) Prior Publication Data

US 2010/0046987 A1 Feb. 25, 2010

(30) Foreign Application Priority Data

Aug. 19, 2008 (JP) ..... 2008-210765

(51) Int. Cl.
*G03G 15/02* (2006.01)

(52) U.S. Cl. ..... 399/176; 399/111; 399/115

(58) Field of Classification Search ..... 399/107, 399/110, 111, 115, 168, 174, 176
See application file for complete search history.

(56) References Cited

U.S. PATENT DOCUMENTS

| | | | | |
|---|---|---|---|---|
| 4,851,960 | A | 7/1989 | Nakamura | |
| 7,171,141 | B2 * | 1/2007 | Abe et al. | 399/176 |
| 2008/0075505 | A1 * | 3/2008 | Nagamori et al. | 399/176 |
| 2008/0124131 | A1 | 5/2008 | Higaki | |

FOREIGN PATENT DOCUMENTS

| | | | |
|---|---|---|---|
| JP | 3-101768 | A | 4/1991 |
| JP | 10-213945 | A | 8/1998 |
| JP | 2007-298820 | A | 11/2007 |
| JP | 2008-122781 | A | 5/2008 |

* cited by examiner

*Primary Examiner* — Hoan Tran
(74) *Attorney, Agent, or Firm* — Canon U.S.A. Inc., I.P. Division

(57) ABSTRACT

The present invention provides a charging member, a charging device, an image forming apparatus, and a process cartridge that minimize local unevenness in potential of a charged object resulting from soiling of the charging member with soiling microparticles or soiling aggregates, that do not cause image failure such as unevenness in image density and scumming, and that output good images through the life of the charging member. The charging member charges a surface of the object by receiving a voltage while being in contact with the object, and satisfies the condition that Rzjis≦30 and Rsk≦0, where Rzjis represents the ten-point average roughness of a surface of the charging member in contact with the object and Rsk represents the skewness of a roughness curve.

9 Claims, 8 Drawing Sheets

CHARGING MEMBER, CHARGING DEVICE, IMAGE FORMING APPARATUS, AND PROCESS CARTRIDGE

BACKGROUND OF THE INVENTION

1. Field of the Invention

The present invention relates to a charging member, a charging device, an image forming apparatus, and a process cartridge.

Here, an image forming apparatus refers to an apparatus that forms an image on a recording medium by an electrophotographic image forming method. Examples of image forming apparatuses are an electrophotographic copying machine, an electrophotographic printer (e.g., a laser beam printer or an LED printer), a facsimile machine, and a word processor.

A process cartridge refers to a cartridge serving as a process unit into which at least a charging device and an electrophotographic photosensitive member are combined, and which is removably mounted in a main body of the image forming apparatus.

2. Description of the Related Art (1) Image Forming Process

FIG. 2 schematically shows a configuration of an image forming apparatus of the related art. This image forming apparatus is an electrophotographic copying machine, printer, facsimile machine, or word processor. An electrophotographic photosensitive member 100 shaped like a rotating drum (hereinafter referred to as a photosensitive drum) is rotated at a predetermined peripheral speed in a clockwise direction shown by the arrow. During rotation, the photosensitive drum 100 is uniformly charged to a predetermined polarity and potential by a charging device 101, and is then subjected to image exposure by an exposure device 102, whereby an electrostatic latent image is formed on a surface of the photosensitive drum 100. The electrostatic latent image is developed into a visual toner image by a developing device 103. The toner image on the surface of the photosensitive drum 100 is transferred, by a transfer device 105, onto a recording medium 104, such as paper, supplied from a sheet feeding section (not shown). The recording medium 104 on which the toner image is transferred is separated from the surface of the photosensitive drum 100, and is guided into a fixing device 106, where the toner image is fixed. After that, the recording medium 104 is ejected as an image-bearing medium. After the recording medium 104 is separated, the surface of the photosensitive drum 100 is cleaned with a cleaning device 107 by scraping off residual toner, and is repeatedly used for image formation.

(2) Charging Device

A charging bias source applies a charging bias voltage to a charging member of the charging device 101. In a typical charging method for applying only a direct-current voltage as a charging bias voltage, discharging occurs when a voltage more than or equal to a certain threshold voltage is applied, and this charges the photosensitive drum 100 (hereinafter this charging method is referred to as DC charging).

U.S. Pat. No. 4,851,960 discloses a charging method for applying a bias voltage obtained by superimposing, on a direct-current voltage Vdc corresponding to a desired dark potential Vd on the drum, an alternating-current voltage having a peak-to-peak voltage Vpp that is more than or equal to double that of a discharging start voltage at the application of the direct-current voltage. Hereinafter, a direct current is referred to as a DC, an alternating current is referred to as an AC, and this charging method is referred to as AC/DC charging. This charging method is excellent in uniformly charging the photosensitive drum 100. When an AC voltage higher than or equal to a predetermined voltage is superimposed on a DC voltage, local unevenness in potential (charging failure) on the photosensitive drum 100 is overcome by a potential uniforming effect of an AC component, and the charged potential Vd on the surface of the photosensitive drum 100 uniformly converges to the DC voltage Vdc. In AC/DC charging, however, the value of discharging current for the photosensitive drum 100 is larger than in DC charging for applying only a DC voltage. For this reason, chains linking molecules on the surface of the photosensitive drum 100 are easily cut, and the photosensitive drum 100 is easily shaved by a cleaning blade of the cleaning device 107. This shortens the life of the photosensitive drum 100.

The charging device 101 typically adopts a contact charging method that charges the surface of the photosensitive drum by applying a voltage to a charging member that is shaped like, for example, a roller or a blade and that is in contact with the surface of the photosensitive drum. In particular, a charging method using a roller allows stable charging over a long period of time.

However, the charging roller is soiled with a soiling substance through repetitive image forming processes, and nonuniform charging resulting from the soiled charging member sometimes causes image failure such as unevenness in image density and scumming. Soiling of the charging member is caused by adhesion of part of the toner, which remains on the photosensitive drum 100 after transfer, onto the charging roller. To overcome this problem, Japanese Patent Laid-Open Nos. 2007-298820 and 2008-122781 disclose a technique of reducing adhesiveness of a soiling substance onto a charging roller by decreasing the surface roughness Rzjis of the charging roller. This technique has a certain effect on soiling of the charging member.

Japanese Patent Laid-Open No. 3-101768 discloses a technique of reducing soiling of a charging roller by sliding a cleaning member on the charging roller. Further, Japanese Patent Laid-Open No. 10-213945 discloses another technique that is effective against soiling of a charging member. In this technique, a cleaning member for a charging roller functions as a charge application member, and applies charge to toner serving as a soiling substance so as to move the toner onto a photosensitive drum.

A description will now be given of the background art of the problems to be solved by the present invention.

It is known that a soiling substance formed by microparticles (hereinafter referred to as soiling microparticles), such as part of toner remaining on a photosensitive drum after transfer, soils a charging roller. Adhesion of soiling microparticles causes local unevenness in potential on the photosensitive drum, and this is one of the factors that cause image failure such as nonuniform density and scumming.

A description will now be given of an example of a process in which soiling microparticles are produced.

For example, in an image forming apparatus equipped with a cleaning member, when part of toner remaining on a photosensitive drum after transfer passes by the cleaning member, it sometimes adheres onto a surface of a charging roller in contact with the photosensitive drum. Further, in a cleanerless method for removing toner, which remains on a photosensitive drum after transfer, by cleaning performed simultaneously with development and recovering the toner for reuse, more soiling microparticles exist on the photosensitive drum, and soil the charging roller. When microparticles other than the toner, for example, external additives, paper dust, shavings of the photosensitive drum, microparticles floating in the air, and microparticles adhering to paper, adhere onto the charging roller, nonuniform charging also occurs. For this reason, there has been a demand for a charging member onto which soiling microparticles do not easy adhere.

Particularly in DC charging, the photosensitive drum is less susceptible to shaving and has a longer life than in AC/DC charging. On the other hand, since a uniforming effect of an AC component is not provided, unevenness in potential is easily caused on the photosensitive drum by soiling of the charging roller, and image failure easily occurs.

When the charging roller is driven by rotation of the photosensitive drum, it is known that the charging roller achieves a pronounced effect in scraping the soiling substance off the photosensitive drum.

In addition, in the image forming apparatus using the cleaner-less method, the charging roller is exposed to more soiling substances.

SUMMARY OF THE INVENTION

The present invention reduces adhesiveness of soiling microparticles. The present invention also provides a charging member, a charging device, an image forming apparatus, and a process cartridge that minimize nonuniform charging due to soiling microparticles, that do not cause image failure, such as unevenness in image density and scumming, and that output good images through the life of the charging member.

Further features of the present invention will become apparent from the following description of exemplary embodiments with reference to the attached drawings.

DESCRIPTION OF THE EMBODIMENTS

First Embodiment

A charging member, a charging device including the charging member, a process cartridge including the charging member, and an image forming apparatus according to a first embodiment of the present invention will be described in detail below with reference to the drawings.

(1) Outline of Configuration and Operation of Image Forming Apparatus

Figure 3:
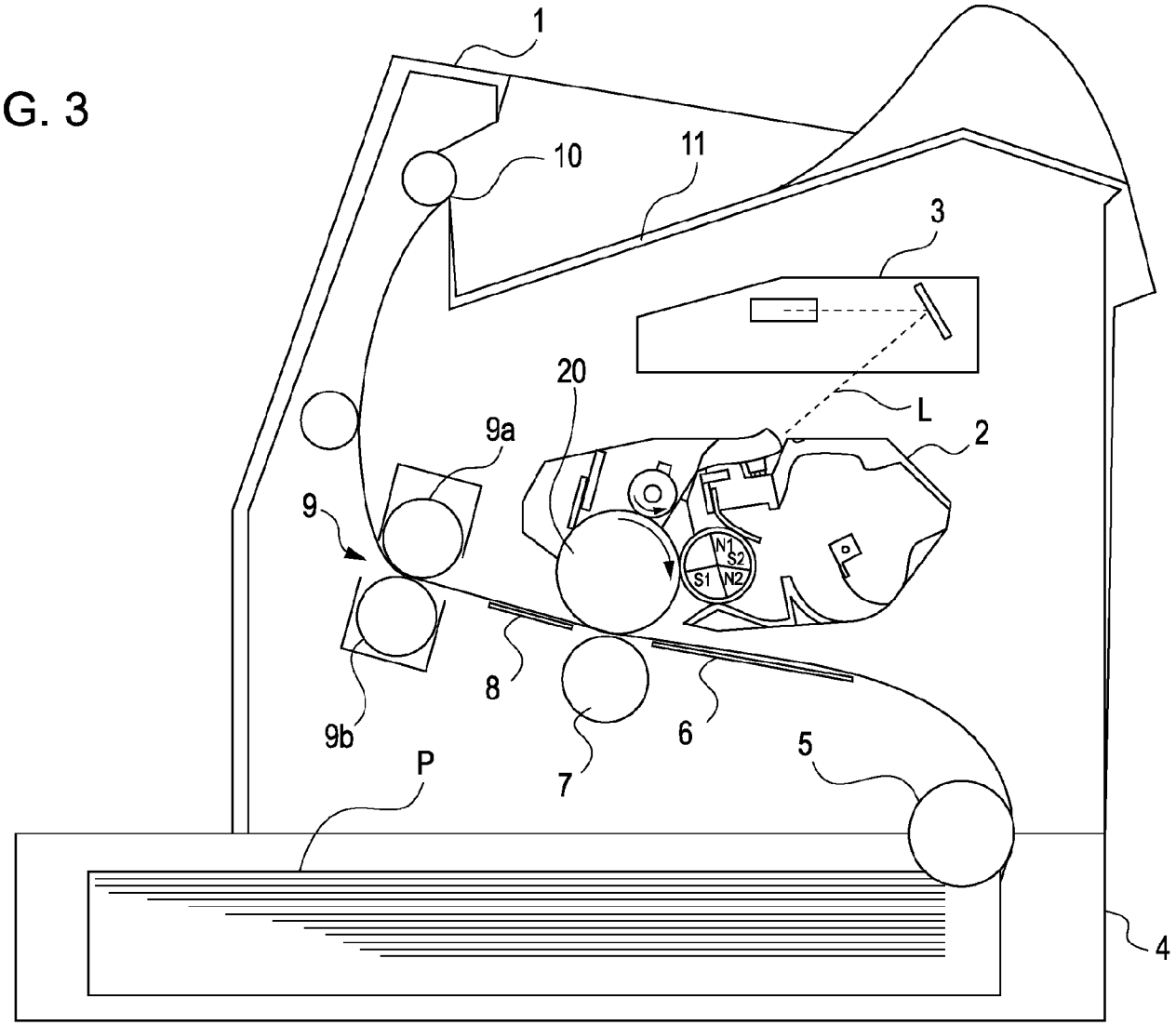
FIG. 3 is a longitudinal sectional view of an image forming apparatus according to the first embodiment.

FIG. 3 schematically shows a configuration of an image forming apparatus according to the first embodiment. This image forming apparatus is an electrophotographic laser beam printer in which a process cartridge is mounted removably. An external host apparatus (not shown), such as a personal computer or an image reader, is connected to the printer. The printer outputs a print according to image information input from the host apparatus to a controller (not shown). The controller exchanges signals with the host apparatus. The controller also exchanges signals with an image forming device to control an image forming sequence.

The printer includes a printer body (image forming apparatus body) 1, and a process cartridge 2 that is removably mounted in the printer body 1. Details of the process cartridge 2 will be described below with reference to FIG. 4.

A drum-shaped electrophotographic photosensitive member (hereinafter referred to as a photosensitive drum) 20 serves as an image bearing member. The photosensitive drum 20 is rotated at a peripheral speed (process speed) of 120.0 mm/s in the clockwise direction shown by arrow R1 in response to a print start signal. A charging member (charging roller) 30 to which a charging bias is applied is in contact with the photosensitive drum 20, and is driven by the photosensitive drum 20 in the direction of arrow R2. The charging roller 30 uniformly charges a peripheral surface of the rotating photosensitive drum 20 to a predetermined polarity and potential. In the first embodiment, the peripheral surface is charged to a predetermined negative potential. The charging roller 30 will be described below.

An exposure device (laser scanner unit) 3 serving as an exposure unit exposes the charged surface to laser scanning light L corresponding to image information. The laser light L emitted from the exposure device 3 enters the cartridge 2 from an exposure window 53 provided in an upper surface of the cartridge 2, and exposes the surface of the photosensitive drum 20. The exposure device 3 outputs laser light modulated (on/off converted) according to time-sequential electric digital pixel signals of the image information input from the host apparatus to the controller, and scans the laser light over the uniformly charged surface of the photosensitive drum 20. Potentials attenuate in a portion (exposed bright portion) of the surface of the photosensitive drum 20 irradiated with the laser light L, whereby an electrostatic latent image corresponding to the image information is formed on the surface of the photosensitive drum 20. The first embodiment adopts an image exposure method for exposing an image information portion.

The electrostatic latent image is developed with developing agent on a developing sleeve (developing roller) 41 serving as a developing-agent bearing member in a developing device 40. In the first embodiment, the developing device 40 adopts a jumping development method using a mono-component magnetic toner (hereinafter referred to as toner) as the developing agent, and a reversal development method for developing an exposed bright portion of an electrostatic latent image with negative toner.

A pickup roller 5 in a sheet tray 4 starts at a predetermined control time to separate and feed one of the sheet materials (sheets) P stacked in the sheet tray 4. The sheet material P passes through a conveying path including a supply roller and a conveying roller (not shown), enters a transfer nip at a contact portion between the photosensitive drum 20 and a transfer charging roller 7 via a transfer guide 6 at a predetermined control time. While the sheet material P is being conveyed through the transfer nip, a transfer bias having a polarity opposite the polarity of the toner is applied to the transfer charging roller 7, so that toner images on the photosensitive drum 20 are electrostatically transferred in order onto a surface of the sheet material P.

The sheet material P exits from the transfer nip, separates from the surface of the photosensitive drum 20, travels along a conveyance guide 8, and enters a fixing nip at a contact portion between a fixing roller 9*a* and a pressure roller 9*b* in a fixing device 9. After the sheet material P separates from the surface of the photosensitive drum 20, the surface is cleaned by removing a soiling substance, such as toner, remaining after transfer with a cleaning blade serving as a cleaning device 50, and is repeatedly used for image formation starting with a charging process.

The sheet material P put into the fixing device 9 is subjected to a process of heating and pressing the toner image while being conveyed through the fixing nip. The sheet material P exits from the fixing device 9, passes through an upward conveying path including a conveying roller, and is ejected onto an output tray 11 by an ejection roller 10.

(2) Process Cartridge 2

Figure 4:
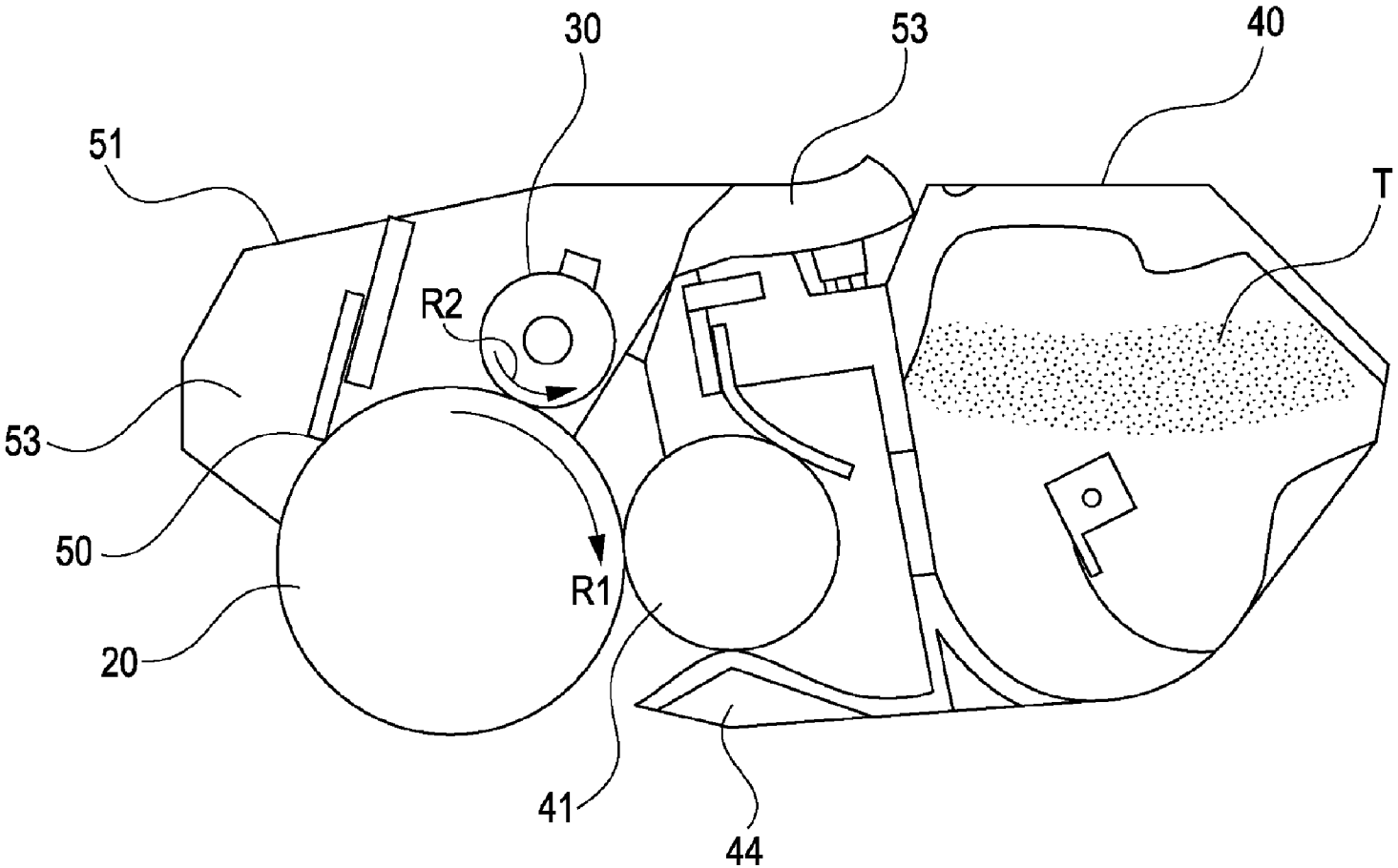
FIG. 4 is a longitudinal sectional view of a process cartridge.

The cartridge 2 provided in the printer of the first embodiment shown in FIG. 3 will now be described with reference to FIG. 4 serving as an enlarged cross-sectional view. Referring to FIG. 4, the cartridge 2 is a combination of four process devices, namely, the photosensitive drum 20 serving as the image bearing member, the charging roller 30, the developing device 40, and the cleaning device 50. The cartridge 2 is detachably mounted in the printer body 1.

In a state in which a cover (not shown) of the printer body 1 is open to expose the interior of the printer body 1, the cartridge 2 is inserted or removed along a guide portion (not shown). When the cartridge 2 is mounted in the printer body 1, the exposure device 3 is located above the cartridge 2, and the sheet tray 4 is located below the cartridge 2.

The photosensitive drum 20 and the charging roller 30 are attached to a frame 51 of the cleaning device 50. The cleaning device 50 is formed by an elastic rubber blade. The photosensitive drum 20, the charging roller 30, and the cleaning device 50 constitute a cleaning unit. The developing device 40 includes a developing container (developing chamber, developing-agent supply chamber) 44 in which a developing sleeve 41 is rotatably provided at an opening, and a developing-agent storage chamber (hereinafter referred to as a toner chamber) 45 that stores toner T. The development container 44 and the toner chamber 45 are combined into a development unit separate from the cleaning unit.

(3) Charging Device

Figure 1:
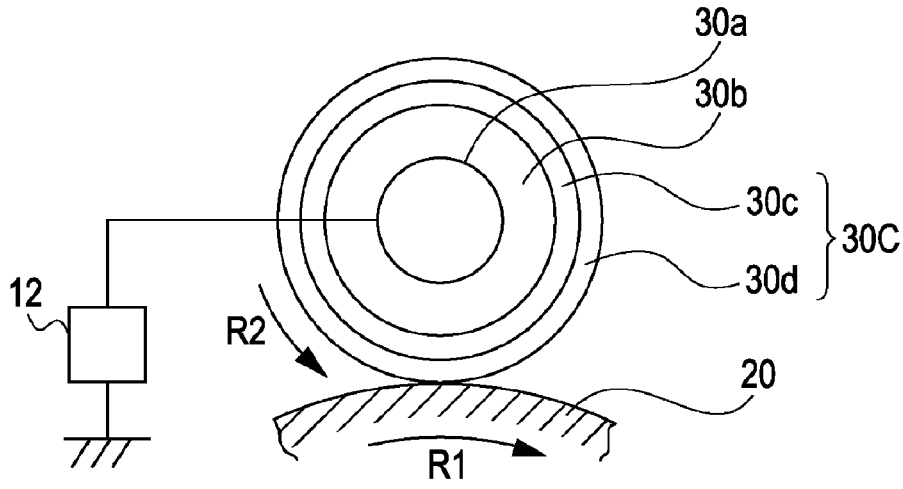
FIG. 1 is a structural view of the principal part of a charging device according to a first embodiment.
Figure 2:
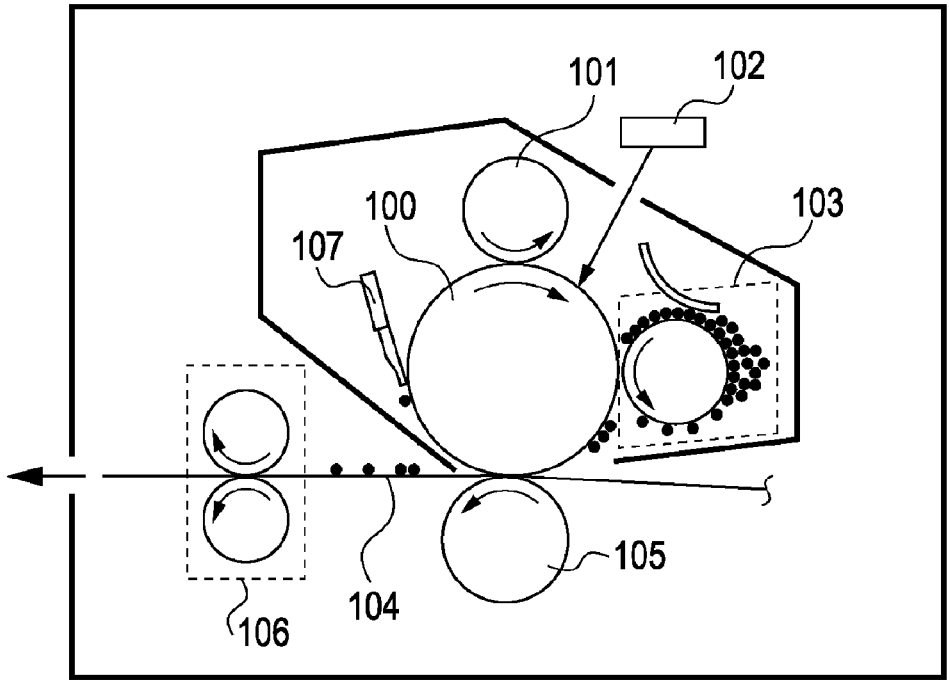
FIG. 2 is a schematic view of an image forming apparatus of the related art.
Figure 5:
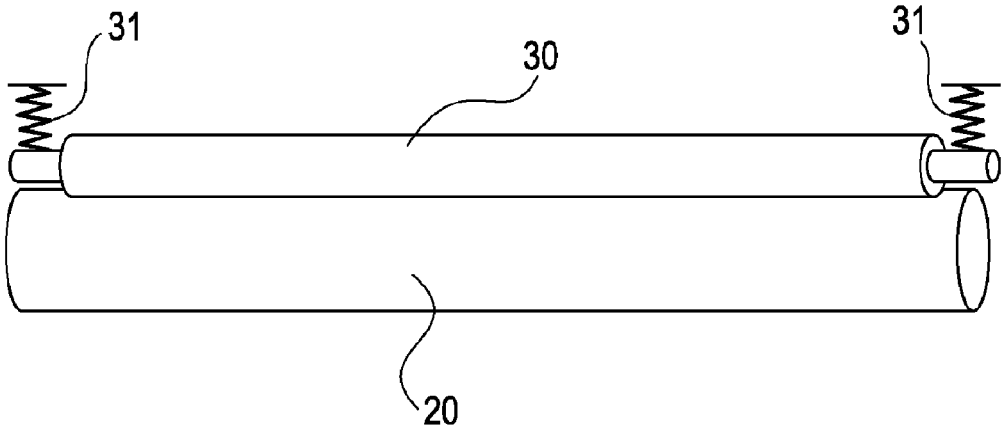
FIG. 5 is a front view of the charging device.

FIG. 1 is a schematic cross-sectional view of the charging roller 30 serving as the charging member in the present invention. FIG. 5 is a schematic front view of the charging roller 30 and the photosensitive drum 20 serving as a member to be charged. A charging device includes the charging roller 30 and a power supply 12 serving as a voltage application unit.

Referring to these figures, the photosensitive drum 20 serving as a member to be charged (image bearing member) is rotatable, and is to be charged negatively or positively. The charging roller 30 serves as a contact charging member, and includes a core bar 30a serving as a support member and formed of metal, such as stainless steel, an elastic member 30*b* surrounding the core bar 30*a*, and a tube layer 30C surrounding the elastic member 30*b*. The elastic member 30*b* is a non-foam elastic member (conductive elastic member) shaped like a roller and provided coaxially with and around the core bar 30*a*. The tube layer 30C that covers the outer peripheral surface of the conductive elastic member 30*b* includes a resistive layer 30*c* and a surface layer 30*d* provided thereon. The outer diameter of the charging roller 30 is 14 mm.

The volume resistivity of the resistive layer 30*c* is $10^4$ to $10^{12}$ Ω·cm, and preferably, is adjusted to $10^7$ to $10^{10}$ Ω·cm. The surface layer 30*d* is formed of a conductive resin, a nonconductive resin in which conductive particles are dispersed, rubber or elastomer in which conductive particles are dispersed, a semiconductive resin, or a semiconductive resin in which conductive particles are dispersed.

In the first embodiment, the tube layer 30*c* on the conductive elastic member 30*b* is a functional multilayer tube, and covers the conductive elastic member 30*b*.

The functional multilayer tube is formed by subjecting a conductive polymer composition, which contains resin particles (polyurethane particles) having an average particle diameter of 5 μm and resin particles (polyurethane particles) having an average particle diameter of 15 μm at a ratio by weight of 1:1, to extrusion molding. During extrusion, the resin particles move on a surface of the softened tube to form concave portions on the downstream side in the extrusion direction and to make the surface of the tube asymmetry, thereby molding a tube having desired ten-point average roughness Rzjis and skewness of roughness curve Rsk that characterize the present invention.

In the first embodiment, the size of the concave portions formed during extrusion, and Rzjis and Rsk are controlled by adjusting the softening degree of the conductive polymer composition in accordance with the temperature of the conductive polymer composition during molding.

In addition, in the first embodiment, the conductive polymer composition contains resin particles having different particle diameters. Since resin particles having the smaller diameter do not easily move on the surface of the softened tube during extrusion, they rarely make the surface asymmetric and uneven such that Rsk is less than 0. In contrast, since resin particles having the larger particle diameter easily move on the surface of the softened tube during extrusion, they form concave portions on the downstream side in the extrusion direction, and make the surface asymmetric and uneven such that Rsk is less than 0. While Rzjis and Rsk are intentionally controlled using this characteristic in the first embodiment, the control method is not limited thereto. Alternatively, even when resin particles of one type are used, an asymmetric uneven surface can be formed and Rzjis and Rsk can be controlled by the molding temperature and the extrusion speed. In this case, it is preferable to use resin particles having an average particle diameter that is more than or equal to 3 μm and less than 40 μm.

Both ends of the core bar 30*a* are rotatably held by bearing members, and are urged toward the photosensitive drum 20 by pressure springs 31, so that the charging roller 30 is in pressing contact with the surface of the photosensitive drum 20 with a predetermined pressure (total pressure 1000 gf). The charging roller 30 is driven in a direction of arrow R2 by the rotation of the photosensitive drum 20 in a direction of arrow R1. A predetermined DC voltage is applied from the power supply 12 to the charging roller 30 via the core bar 30*a*, whereby the peripheral surface of the rotating photosensitive drum 20 is charged to a predetermined potential.

While the charging roller is used as the charging member in the first embodiment, the present invention reduces adhesiveness of the soiling substance by giving a predetermined shape to the surface of the charging member, and the charging member is not limited to the charging roller molded by the above-described molding method. Also, the charging member may be shaped like, for example, a blade.

(3-1) Soiling and Surface Shape of Charging Roller

A description will now be given of soiling and the surface shape of the charging roller that characterize the present invention.

For example, when a certain soiling substance exists on the photosensitive drum 20 on the downstream side of the cleaning blade 50 and on the upstream side of the charging roller 30 in the driving direction, it sometimes moves onto the charging roller 30 and adheres onto the surface of the charging roller 30 during an image forming process.

During rotation of the photosensitive drum 20, when soiling microparticles X, such as part of toner that remains after transfer and passes by the cleaning blade 50 or other microparticles, adhere to the charging roller 30 in contact with the photosensitive drum 20, the charging roller 30 is soiled with the soiling microparticles X.

The soiling microparticles X may be produced in manners other than the above-described manner. The present invention is characterized in minimizing the adhesiveness of microparticles existing on the photosensitive drum 20 in contact with the charging roller 30. In other words, the adhesiveness of the soiling substance is reduced by intentionally making the surface of the charging roller 30 uneven.

The ten-point average surface roughness Rzjis and the skewness Rsk of the roughness curve will now be described to explain the uneven surface in the present invention.

The ten-point surface roughness (conforming to JIS 1994) Rzjis is defined as follows:

$$Rzjis = \frac{1}{5}\sum_{j=1}^{5} Zpj + Zvj$$

where Zpj represents the height of the j-th highest peak in the roughness curve, and Zvj represents the depth of the j-th deepest valley in the roughness curve.

The skewness (conforming to JIS 2001) Rsk of the roughness curve is defined as follows:

$$Rsk = \frac{1}{Rq^2}\left[\frac{1}{1r}\int_0^{1r} Z^3(x)dx\right]$$

$$Rq = \sqrt{\frac{1}{1r}\int_0^{1r} Z^2(x)dx}$$

where 1r represents the reference length, and Z(x) represents the height of the surface roughness at the position x.

The ten-point surface roughness Rzjis and the skewness Rsk were measured with a surface roughness measuring instrument SE-3500 from Kosaka Laboratory Ltd. More specifically, Rzjis and Rsk were measured at randomly selected six points on the charging member with the above-described measuring instrument, and the average value of the measured values was used. Measurement was performed under the conditions that the measurement length was 8 mm, the cutoff length was 0.8 mm, the measurement speed was 0.5 mm/sec, and the scanning direction was the longitudinal direction of the charging roller 30. The present invention is characterized in measuring Rzjis and Rsk in the longitudinal direction of the charging roller. This is because the charging roller and the photosensitive drum are in contact with each other in the longitudinal direction, and the contact state between the charging roller and the photosensitive drum is important for the advantage of the present invention. Incidentally, FIG. 5 of U.S. Patent Application Publication No. 2008/0124131 A1 shows the surface roughness of the charging roller provided so that Rsk<0. In U.S. Patent Application Publication No. 2008/0124131 A1, however, the surface roughness of the charging roller is set in the direction of sliding contact between the charging roller and the cleaning member. In short, this figure shows the case in which Rsk is measured in the circumferential direction of the charging roller, but does not teach the characteristic of the present invention.

Figure 6:
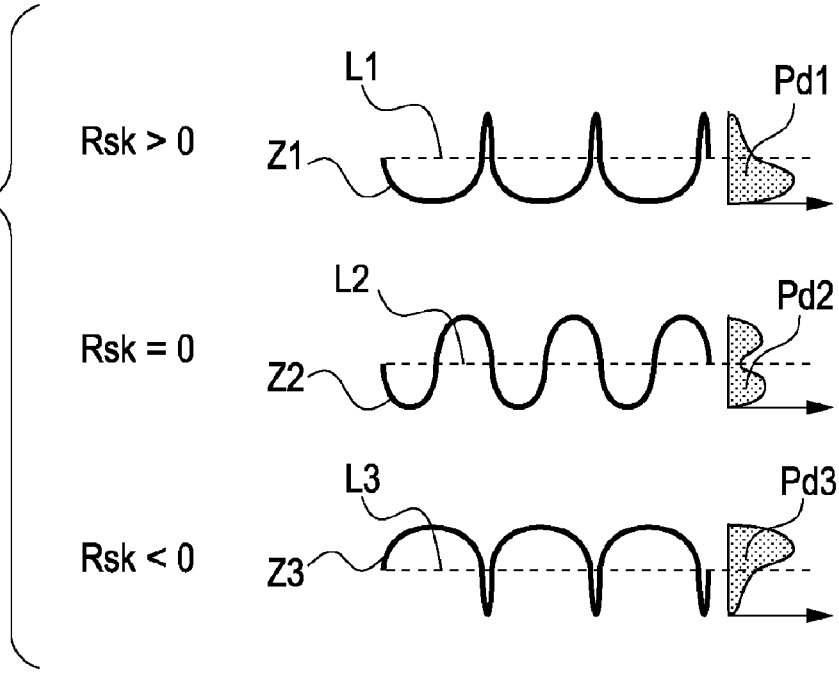
FIG. 6 includes conceptual views showing the roughness curve, the probability density distribution, and the skewness of a roughness curve.

FIG. 6 shows different roughness curves Z1, Z2, and Z3 for a predetermined surface roughness Rzjis, and reference heights L1, L2, and L3 and probability density curves Pd1, Pd2, and Pd3 corresponding to the roughness curves. The probability density curve Pd1 in the roughness curve Z1 that satisfies the condition Rsk>0 has a skewness with respect to the reference height L1. Further, the roughness curve Z2 having the probability density curve Pd2 that has no skewness satisfies the condition Rsk=0. In contrast, the roughness curve Z3 has a skewness in a direction opposite the direction of the roughness curve Z1.

In the first embodiment, the toner T shown in FIG. 4 has an average particle diameter of 8 μm. However, the present inventors verified by thorough examinations that similar advantages for adhesiveness of soiling particles and soiling aggregates, which characterize the present invention, could also be obtained when toner having the average particle diameter of 5 to 12 μm was used.

The toner particle diameter was measured with a Coulter Counter TA-n (from Coulter Corporation) in the following manner. That is, 0.1 to 5 ml of surfactant was added as dispersant into 100 to 150 ml of electrolytic aqueous solution (solution containing 1% of NaCl prepared using 18% of sodium chloride, and 2 to 20 mg of measurement sample (the number of particles is about thirty thousand to three hundred thousand) was further added. As the surfactant, alkyl benzene sulfonate was used. After the electrolytic solution in which the sample is suspended was subjected to dispersion for about 1 to 3 minutes with a ultrasonic dispersion instrument, the average particle diameter was measured with the above-described Coulter Counter.

To explain superiority of the first embodiment, the contact state of the charging roller 30 with the photosensitive drum 20 and the adhesion state of soiling substance to the charging roller 30 will now be described in detail in conjunction with the ten-point average roughness Rzjis and the skewness of the roughness curve.

(3-1a) Surface Shape of Charging Roller and Adhesiveness of Soiling Microparticles First, adhesiveness of soiling microparticles to the charging roller is explained by the scraping effect for the surface of the charging roller 30. In other words, soiling particles X on the photosensitive drum 20 are scraped off by convex portions on the surface of the charging roller 30, and adhere to concave portions. Accordingly, by reducing the sizes of the convex and concave portions on the charging roller 30, the scraping effect is reduced, and soiling with the microparticles is effectively reduced. With attention to this phenomenon, a first method for reducing the effect of scraping the surface of the charging roller 30 is to decrease the roughness Rzjis (A[S3*a*] in FIG. 10). A second method is to distort the convex and concave portions so that Rsk<0 (D[S3*a*] in FIG. 10).

The first and second methods will be described with reference to FIG. 10.

Figure 7:
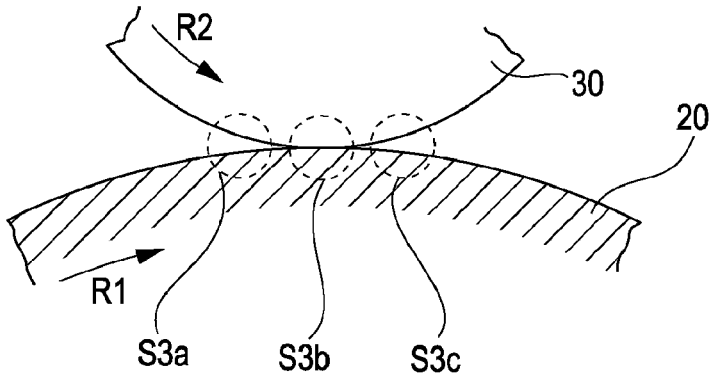
FIG. 7 is an enlarged view showing the adjacency of a contact portion between a charging roller and a photosensitive drum.
Figure 10:
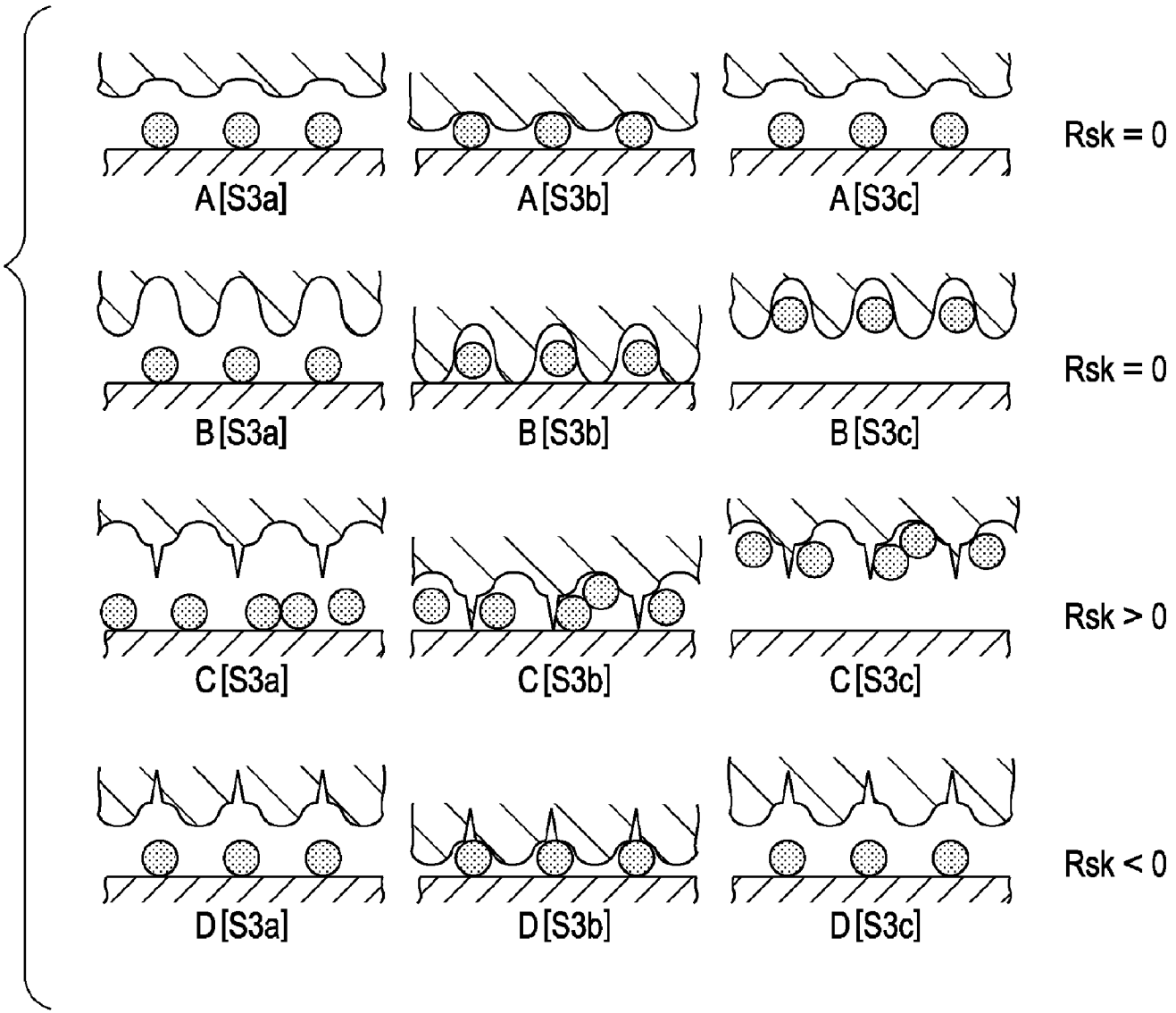
FIG. 10 includes conceptual views explaining adhesiveness of soiling microparticles.

FIG. 10 includes conceptual views showing the adjacencies of the contact nips between charging rollers A, B, C, and D having different surface shapes and the rotating drum 20 during rotation of the photosensitive drum 20. FIG. 10 also shows the behavior of soiling microparticles. In FIG. 10, an upper part of each section shows the surface of the charging roller, and a lower part shows the surface of the photosensitive drum. In FIG. 10, S3*a*, S3*b*, and S3*c* respectively correspond to minute regions S3*a*, S3*b*, and S3*c* in FIG. 7. The charging rollers A, B, C, and D shown in FIG. 10 are as follows:

In the charging roller A, Rsk=0 and Rzjis is low.

In the charging roller B, Rsk=0 and Rzjis is high.

In the charging roller C, Rsk>0 and Rzjis is high.

In the charging roller D, Rsk<0 and Rzjis is high.

However, FIG. 10 includes just conceptual views, and there are, in actuality, influences of, for example, small deformation, small surface unevenness, and local roughness of the charging roller 30. The first embodiment is characterized in the effect of skewnesses of the convex and concave portions on the surface of the charging roller 30 provided by intentionally controlling Rsk, and therefore, the surface shape is not limited to the surface shapes shown in FIG. 10.

Regarding the surface roughness of the charging roller, when Rsk=0 and Rzjis is low, the scraping effect is small, and soiling microparticles X rarely adhere (A[S3*a*], A[S3*b*], and A[S3*c*] in FIG. 10). In contrast, when Rsk=0 and Rzjis is high, the scraping effect is large, and the soiling particles X adhere easily (B[S3*a*], B[S3*b*], and B[S3*c*] in FIG. 10). When Rzjis is high and Rsk>0, the scraping effect further increases, and therefore, the soiling microparticles X adhere more easily (C[S3*a*], C[S3*b*], and C[S3*c*] in FIG. 10). However, when the Rzjis is high, but Rsk<0, the scraping effect is small, and the soiling microparticles X do not adhere easily (D[S3*a*], D[S3*b*], and D[S3*c*] in FIG. 10).

As results of examinations in light of the above, the present inventors found that it was necessary, for desirable adhesiveness of the soiling microparticles X, that the surface shape of the charging roller 30 should be determined to satisfy the following Expression (1) or (2):

$$\text{Rzjis} \leqq 6\ \mu\text{m (Rsk is arbitrary)} \quad (1)$$

$$\text{Rzjis} \leqq 30\ \mu\text{m and Rsk} < 0 \quad (2)$$

Table 1 shows the relationship between the adhesiveness of the soiling microparticles X and the surface shapes of the charging roller 30 that are similar to the surface shapes specified by Expression (1) and (2). In a verification experiment, after 3000 sheets having a print percentage of 2.0% were caused to pass each of the charging rollers having different surface shapes, the occurrence levels of unevenness in density of halftone images were observed.

Unevenness in density was measured with a reflection densitometer (a Macbeth densitometer RD-918). In Table 1, A represents a case in which the difference in reflectance density between two points due to soiling is 0.1 or less, B represents a case in which the difference is between 0.1 and 0.2, and C represents a case in which the difference is 0.2 or more.

Table 1 shows that adhesion of the soiling microparticles X can be reduced by giving the charging roller 30 a surface shape that satisfies Expression (1) or (2). From the viewpoint of adhesiveness of soiling microparticles, when Rsk<−1.0, the scraping effect is further reduced, and this is effective for adhesion of the soiling microparticles.

TABLE 1

Relationship of Image Failure and Rzjis and Rsk (unevenness in density due to soiling microparticles)

| | Rzjis [μm] | Rsk | Unevenness in Density (Soiling Microparticles) |
|---|---|---|---|
| 1) | 3 | +0.9 | A |
| 2) | 3 | −0.3 | A |
| 3) | 6 | +0.1 | A |
| 4) | 6 | −0.1 | A |
| 5) | 7 | +0.0 | C |
| 6) | 7 | −1.0 | A |
| 13) | 10 | +0.3 | C |
| 14) | 10 | −0.5 | A |
| 15) | 20 | +0.8 | C |
| 16) | 20 | −0.7 | A |
| 17) | 30 | −0.1 | B |
| 18) | 40 | −0.3 | C |

(3-1b) Surface Shape of Charging Roller and Adhesiveness of Soiling Aggregate

Substances for soiling the charging roller include not only the soiling microparticles, but also various aggregates of microparticles (hereinafter referred to as soiling aggregates). When a soiling aggregate is present on the photosensitive drum in contact with the charging roller, it sometimes soils the charging roller. Similarly to the soiling microparticles, this soiling aggregate is one of the factors that cause image failure, such as unevenness in density and scumming, resulting from local unevenness in potential on the photosensitive drum. An example of a process in which a soiling aggregate is produced will be given below.

Figure 8A:
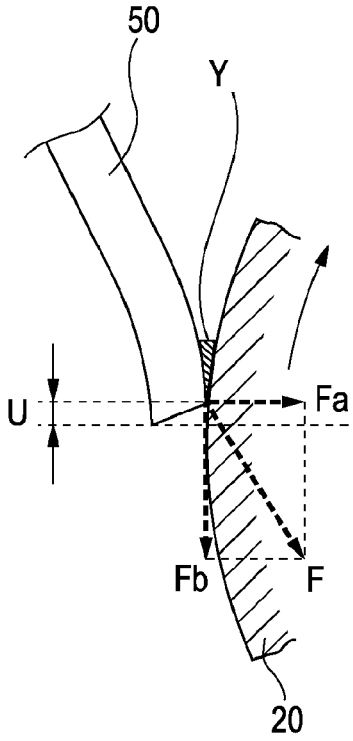
FIGS. 8A and 8B are schematic views showing elastic deformation and elastic relaxation of a cleaning blade.
Figure 8B:
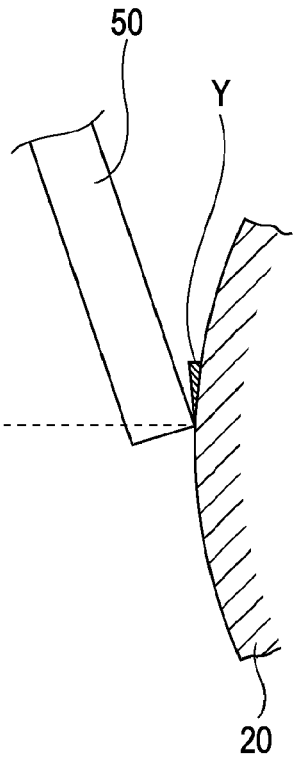

For example, a soling aggregate Y is sometimes produced near a contact portion between the cleaning blade 50 and the photosensitive drum 20 while repeating an image forming operation and a non-image forming operation. Here, the soiling aggregate Y refers to an aggregate of external additives, paper dust, shavings of the photosensitive drum 20, microparticles floating in the air, and microparticles adhering to paper. When the cleaning blade 50 is formed of elastic rubber, it presses the photosensitive drum 20 with a force F generated by elastic deformation during rotation of the photosensitive drum 20, as shown in FIG. 8A. A force perpendicularly acting on the surface of the photosensitive drum 20 is represented by component force Fa. While a soiling aggregate Y is crushed by the force Fa, it is sometimes transferred onto the photosensitive drum 20 when the cleaning blade 50 elastically relaxes and moves by a displacement amount "u" toward the upstream side in the driving direction of the photosensitive drum 20, as shown in FIG. 8B. During rotation of the photosensitive drum 20, the soiling aggregate Y transferred on the photosensitive drum 20 is further transferred onto the surface of the charging roller 20 through Steps S1, S2, S3, and S4 shown in FIG. 9, thus soiling the charging roller 20.

However, since the soiling aggregate is formed by aggregation of various microparticles and adheres onto the charging roller, the process in which the soiling aggregate is produced is not limited to the above-described process.

Further, it is known that the soiling aggregate is different from the above-described soiling microparticles in adhesiveness to the charging roller. Adhesiveness will be described in detail below.

As results of thorough examinations, the present inventors found that the adhesiveness of the soiling aggregate Y to the charging roller 30 could be explained by the microscopic effect of the charging roller 30 for pressing the soiling aggregate Y on the photosensitive drum 20. In other words, when the soiling aggregate Y is crushed at the contact portion between the photosensitive drum 20 and the charging roller 30, as the area of a portion where a high microscopic pressure is applied to the soiling aggregate Y increases, the soiling aggregate Y more easily adheres to the portion. Conversely, when there are many portions where the photosensitive drum 20 and the charging roller 30 are not microscopically in contact with each other or the microscopic pressure is low, adhesion of the soiling aggregate Y rarely occurs.

With attention to this pressing effect, it is conceivable to increase Rzjis in order to reduce the microscopic pressure of the surface of the charging roller. This can be realized by making the surface of the charging roller uneven in such a manner as that convex portions are in point contact with the photosensitive drum 20 and that the pressure is low in concave portions when the soiling aggregate Y is crushed and the concave portions are not in contact with the soiling aggregate Y.

The above-described method will now be described with reference to FIG. 11.

Figure 9:
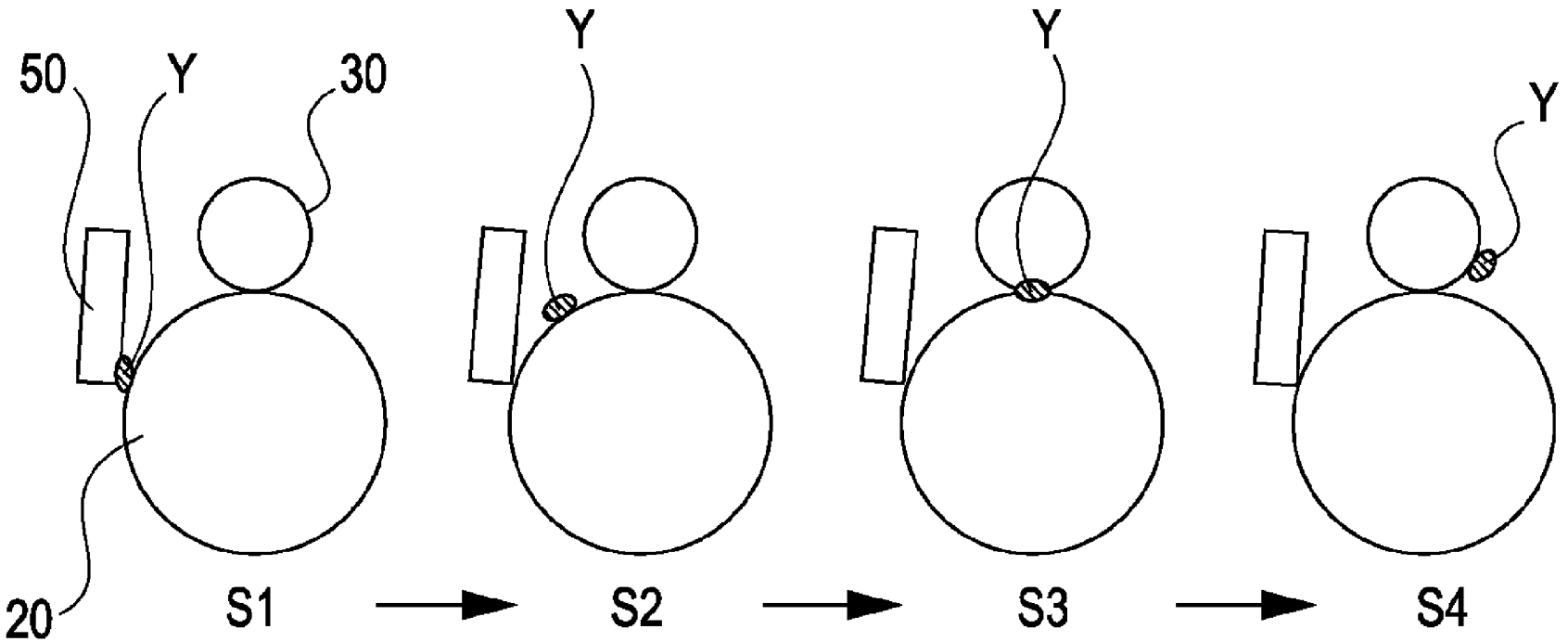
FIG. 9 is a schematic view showing a process in which a soiling aggregate is produced.
Figure 11:
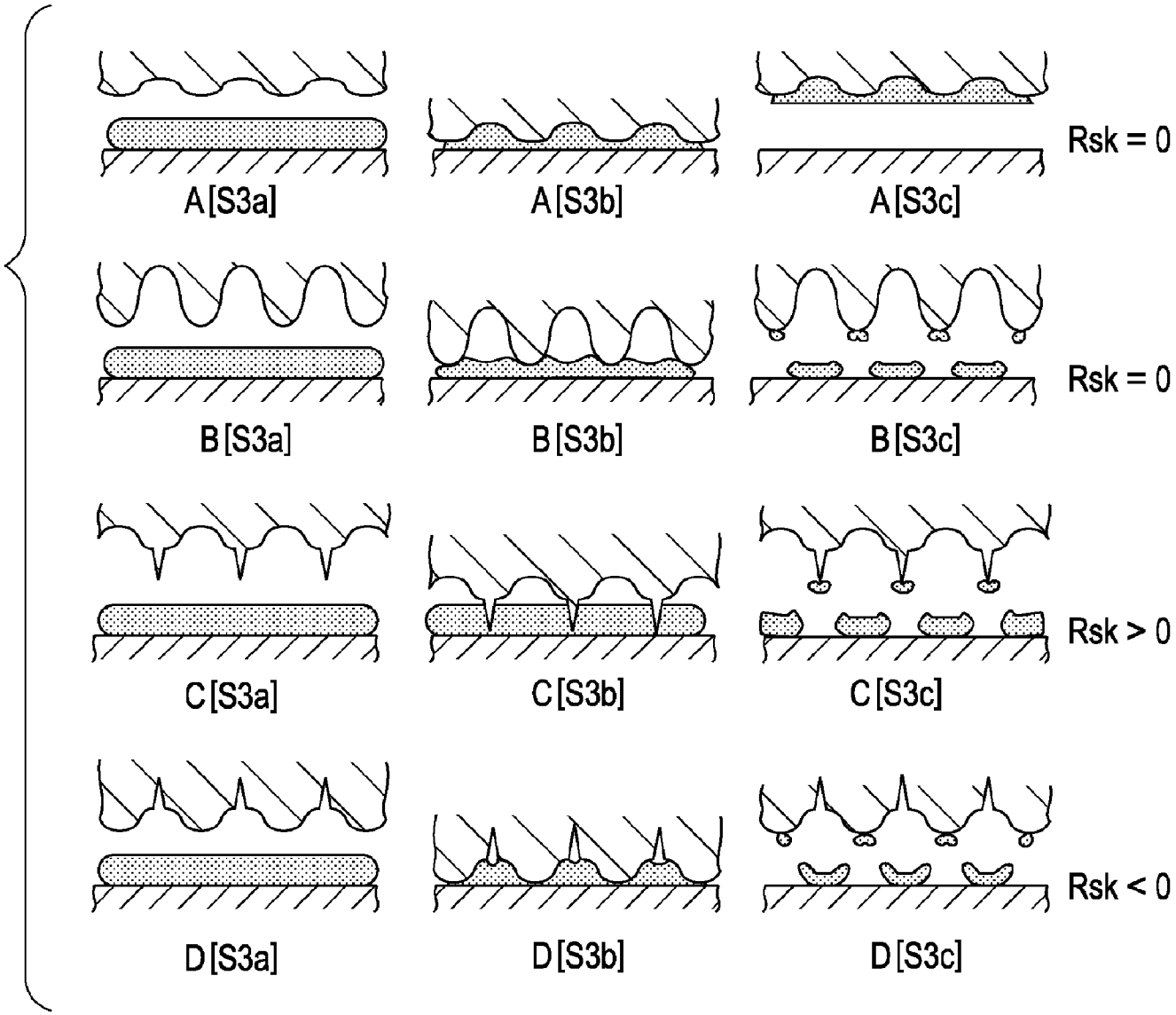
FIG. 11 includes conceptual views explaining adhesiveness of soiling aggregates.

FIG. 11 includes conceptual views showing the adjacencies of contact nips between charging rollers A, B, C, and D having different surface shapes and the charging roller 30 during rotation of the photosensitive drum 20 (in Step S3 in FIG. 9). FIG. 11 also shows the behavior of soiling aggregates Y. In FIG. 11, an upper part of each section shows the surface of the charging roller, and a lower part shows the surface of the photosensitive drum. In FIG. 11, S3*a*, S3*b*, and S3*c* respectively correspond to the minute regions S3*a*, S3*b*, and S3*c* in FIG. 7. The charging rollers A, B, C, and D shown in FIG. 11 are as follows:

In the charging roller A, Rsk=0 and Rzjis is low.
In the charging roller B, Rsk=0 and Rzjis is high.
In the charging roller C, Rsk>0 and Rzjis is high.
In the charging roller D, Rsk<0 and Rzjis is high.

However, FIG. 11 includes just conceptual views, and there are, in actuality, influences of, for example, small deformation, small surface unevenness, and local roughness of the charging roller 30. The first embodiment is characterized in the effect of skewnesses of the convex and concave portions on the surface of the charging roller 30 formed by intentionally controlling Rsk, and therefore, the surface shape is not limited to the surface shapes shown in FIG. 11.

Regarding the surface roughness of the charging roller, when Rzjis is low, the area of the portion where the pressure is high is large, and the soiling aggregates Y easily adhere (A[S3*a*], A[S3*b*], and A[S3*c*] in FIG. 11).

In contrast, when Rzjis is high, the area of the portion where the pressure is high is small, regardless of Rsk, and the soiling aggregates Y rarely adhere (B[S3*a*], B[S3*b*], and B[S3*c*], C[S3*a*], C[S3*b*], and C[S3*c*], and D[S3*a*], D[S3*b*], and D[S3*c*] in FIG. 11).

As results of thorough examinations in light of the above, the present inventors found that it was necessary, for desirable adhesiveness of the soiling aggregates Y, that the surface shape of the charging roller 30 should be determined to satisfy the following Expression (3):

$$\text{Rzjis} \geqq 7\ \mu\text{m (Rsk is arbitrary)} \quad (3)$$

Table 2 shows the relationship between the adhesiveness of the soiling aggregates Y and the surface shapes of the charging roller 30 that are similar to the surface shapes specified by Expression (3). In a verification experiment, after 3000 sheets having a print percentage of 2.0% were caused to pass each of the charging rollers having different surface shapes, the occurrence levels of unevenness in density of solid white images were observed after the solid white images were left for one day.

In Table 2, A represents a case in which unevenness in density was not found on the image, B represents a case in which unevenness in density appeared as black dots on the image, and C represents a case in which unevenness in density appeared as lateral black bands on the image.

Table 2 shows that adhesion of the soiling aggregates Y can be reduced by giving the charging roller 30 a surface shape that satisfies Expression (3).

TABLE 2

Relationships between Rzjis and Rsk and Image Failure (Unevenness in Density due to Soiling Aggregate)

| | Rzjis [μm] | Rsk | Unevenness in Density (Soiling Aggregate) |
|---|---|---|---|
| 1) | 3 | +0.9 | C |
| 2) | 3 | −0.3 | C |
| 3) | 6 | +0.1 | C |
| 4) | 6 | −0.1 | C |
| 5) | 7 | +0.0 | A |
| 6) | 7 | −1.0 | B |
| 13) | 10 | +0.3 | A |
| 14) | 10 | −0.5 | A |
| 15) | 20 | +0.8 | A |
| 16) | 20 | −0.7 | A |
| 17) | 30 | −0.1 | A |
| 18) | 40 | −0.3 | A |

From the above, Expression (1) or (2), and Expression (3) can be satisfied by setting the surface shape of the charging roller according to the following Expression (4), and this reduces both soiling microparticles and soiling aggregates. Moreover, it is possible to provide an image forming apparatus that does not suffer from unevenness in image density and scumming resulting from nonuniform charging.

$$7 \leqq \text{Rzjis} \leqq 30 \text{ and Rsk} < 0 \quad (4)$$

Second Embodiment

A second embodiment realizes space saving by decreasing the outer diameter of a charging roller 30. Since structures of the second embodiment other than the outer diameter of the charging roller 30 and pressure springs 31 for pressing the charging roller 30 against a photosensitive drum 20 are similar to those adopted in the first embodiment, descriptions thereof are omitted.

In the second embodiment, the charging roller 30 has an outer diameter of 8 mm. Since the outer circumference of the charging roller 30 is thereby decreased, the number of soiling substances per unit area on the surface of the charging roller 30 increases.

Further, rigidity of the charging roller 30 is decreased by reducing the outer diameter of the charging roller 30. In the second embodiment, the entire longitudinal area of the charging roller 30 can be pressed against the photosensitive drum 20 with a sufficient contact pressure by setting the total pressure of the pressure springs 31 against both ends of a core bar 30*a* of the charging roller 30 to be 1500 gf. However, since the contact pressure for the photosensitive drum 20 becomes high particularly at the ends of the charging roller 30, the effect of scraping soiling substances and the pressing effect increase, and consequently, the charging roller is susceptible to soiling. In other words, as the pressure of the charging roller 30 against the photosensitive drum 20 increases, the charging roller 30 becomes more susceptible to soiling.

In the second embodiment, in spite of the above, both the soiling microparticles X and the soiling aggregates Y can be reduced by setting the surface shape of the charging roller to satisfy the following Expression (4). Moreover, it is possible to provide an image forming apparatus that does not suffer from unevenness in image density and scumming resulting from nonuniform charging.

$$7 \leqq Rzjis \leqq 30 \text{ and } Rsk < 0 \quad (4)$$

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-210765 filed Aug. 19, 2008, which is hereby incorporated by reference herein in its entirety.

What is claimed is:

1. A charging member that charges a surface of an object by receiving a voltage while being in contact with the object, wherein the charging member satisfies the following conditions:

$$Rzjis \leqq 30, \text{ and}$$

$$Rsk < 0$$

where Rzjis represents the ten-point average roughness of a surface of the charging member in contact with the object, and Rsk represents the skewness of a roughness curve, and wherein Rzjis and Rsk are measured in a longitudinal direction of the charging member.

2. The charging member according to claim 1, wherein the charging member satisfies the following condition:

$$Rzjis \geqq 7.$$

3. The charging member according to claim 1, wherein the charging member is shaped like a roller capable of being held rotatably.

4. An image forming apparatus comprising:

an image bearing member configured to bear an electrostatic latent image;

a charging member configured to charge a surface of the image bearing member by receiving a voltage while being in contact with the image bearing member;

an exposure device configured to form the electrostatic latent image by exposing the charged image bearing member; and a developing device configured to form a toner image by causing toner to adhere to the electrostatic latent image, wherein the charging member satisfies the following conditions:

$$Rzjis \leqq 30, \text{ and}$$

$$Rsk < 0$$

where Rzjis represents the ten-point average roughness of a surface of the charging member in contact with the image bearing member, and Rsk represents the skewness of a roughness curve, and wherein Rzjis and Rsk are measured in a longitudinal direction of the charging member.

5. The image forming apparatus according to claim 4, wherein the charging member satisfies the following condition:

$$Rzjis \geqq 7.$$

6. The image forming apparatus according to claim 4, wherein the charging member is shaped like a roller capable of being held rotatably.

7. A process cartridge separable from a main body of an image forming apparatus, the process cartridge comprising:

an image bearing member configured to bear an electrostatic latent image; and a charging member configured to charge a surface of the image bearing member by receiving a voltage while being in contact with the image bearing member, wherein the charging member satisfies the following conditions:

$$Rzjis \leqq 30, \text{ and}$$

$$Rsk < 0$$

where Rzjis represents the ten-point average roughness of a surface of the charging member in contact with the image bearing member, and Rsk represents the skewness of a roughness curve, and wherein Rzjis and Rsk are measured in a longitudinal direction of the charging member.

8. The process cartridge according to claim 7, wherein the charging member satisfies the following condition:

$$Rzjis \geqq 7.$$

9. The process cartridge according to claim 7, wherein the charging member is shaped like a roller capable of being held rotatably.

* * * * *